US005337759A

United States Patent [19]

Henden Tranås

[11] Patent Number: 5,337,759

[45] Date of Patent: Aug. 16, 1994

[54] APPARATUS FOR INDICATING CORRECT BACK POSTURE

[76] Inventor: Randi Henden Tranås, Nordahl Griegs veg 3B, N-7800 Namsos, Norway

[21] Appl. No.: 50,498

[22] PCT Filed: Nov. 20, 1991

[86] PCT No.: PCT/NO91/00146

§ 371 Date: May 13, 1993

§ 102(e) Date: May 13, 1993

[87] PCT Pub. No.: WO92/09333

PCT Pub. Date: Jun. 11, 1992

[30] Foreign Application Priority Data

Nov. 22, 1990 [NO] Norway ..... 905052

[51] Int. Cl.[5] ..... A61B 10/00

[52] U.S. Cl. ..... 128/782

[58] Field of Search ..... 128/774, 781, 782; 33/511, 512, 514.1

[56] References Cited

U.S. PATENT DOCUMENTS

| | | | |
|---|---|---|---|
| 2,357,746 | 5/1944 | Kuss . | |
| 3,254,444 | 7/1966 | Paterson . | |
| 4,528,990 | 7/1985 | Knowles | 128/782 |
| 4,800,897 | 1/1989 | Nilsson | 128/782 |
| 4,928,709 | 5/1990 | Allison et al. | 128/782 |

FOREIGN PATENT DOCUMENTS 3839494 5/1990 Fed. Rep. of Germany .

*Primary Examiner*—Max Hindenburg

*Attorney, Agent, or Firm*—Merchant & Gould Smith, Edell, Welter & Schmidt

[57] ABSTRACT

An apparatus to be placed on the head of a person to indicate correct or faulty back posture during execution of various activities in an upright or sitting position. The apparatus comprises a balance member (1) connected with a base section (2) adapted to be attached to the person's head (A) by means of a hair band, forehead band, cap, etc. (3), whereby said balance member (1), in the case of head positions and consequent back positions that deviate from correct back posture, will tip in the direction of inclination of the head (A).

7 Claims, 1 Drawing Sheet

APPARATUS FOR INDICATING CORRECT BACK POSTURE

BACKGROUND OF THE INVENTION

The present invention relates to an apparatus to be placed on the head of a person to indicate correct or faulty back posture during execution of various activities in an upright or sitting position.

The apparatus can thus be utilized in daily life at various work places and during the execution of different leisure time activities such as exercizing, gymnastics, aerobics, jogging and ballet.

In connection with back ailments, it has been recommended by a number of doctors, physical therapists and others that the spine should be held as straight as possible during various activities associated with both work and leisure. This applies, for example, to bending, sitting on an office chair, and to lifting.

We do not know, however, of any suitable mechanical aid for holding the back in the correct position during execution of the quite numerous daily activities that produce strain on the spinal column.

SUMMARY OF THE INVENTION

The purpose of the present invention is to provide an apparatus which, when used, will help a person hold the spinal column straight when the person sits on an office chair, has to lift something or bend over, etc.

This is achieved according to the invention by means of the characteristic features disclosed in the characterizing clause of the following independent claim 1 and in the subsequent dependent claims.

Experiments conducted using the apparatus in accordance with the invention have shown that the user's back is held straight and the back posture is correct even during prolonged periods of work with, for example, house cleaning or typing.

The balance member preferably consists of a plate member connected for springing movement with and unstably supported by a base section attached to a hair band, which may be placed on a person's head. At each end of the plate member is attached a weight element, said weight elements causing a moving deflection of the springing, movable plate member when the user's head is moved, and resulting in a swinging motion toward one side or the other, or forward and backward, from an intermediate position which is to indicate correct back posture.

The actual plate member/balance plate may be made of plastic. By providing two parallel incisions in the midsection of the plate from one longitudinal edge toward the other longitudinal edge thereof, and by bending in the strip thus produced into an approximate U-shape under the plate, one forms a hinge strip, the free end of which may be attached to the above mentioned hair band. Depending on the resilient properties of the strip, in order to achieve a desired spring motion between the plate with the weights and the attachment point for the strip, a spring may be positioned between the point of attachment of the strip on the hair band and its origin in the plate member.

BRIEF DESCRIPTION OF THE DRAWINGS

An embodiment example in accordance with the invention will be described further in the following, with reference to the illustration, where FIG. 1 in perspective shows the apparatus positioned on a hair band.

DETAILED DESCRIPTION OF THE PREFERRED EMBODIMENT

Figure 1:
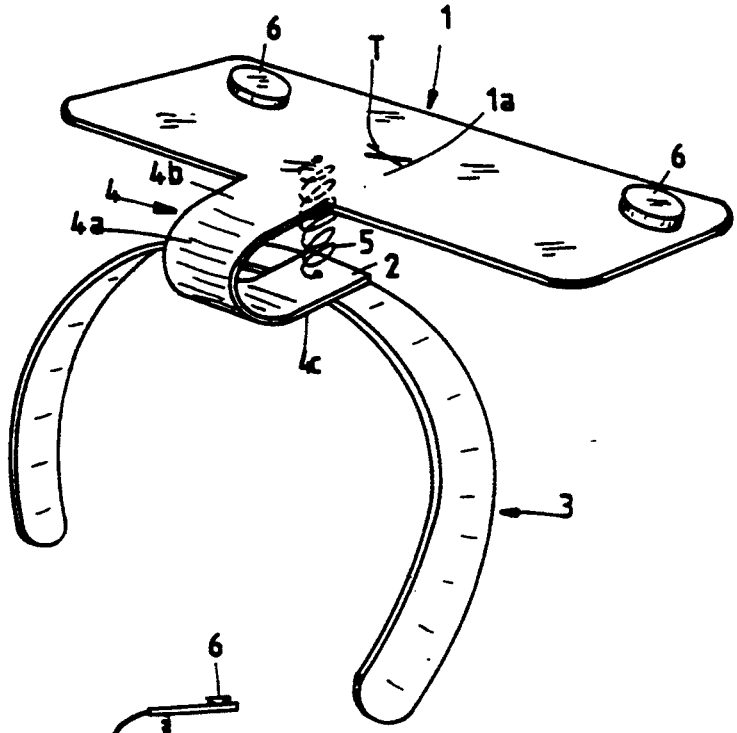
Figure 2:
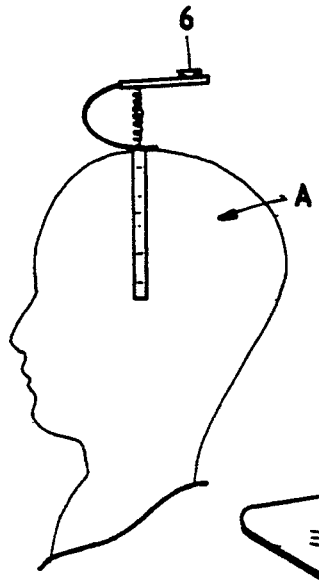
FIG. 2 shows the apparatus seen from the side with the hair band placed on a head.
Figure 4:
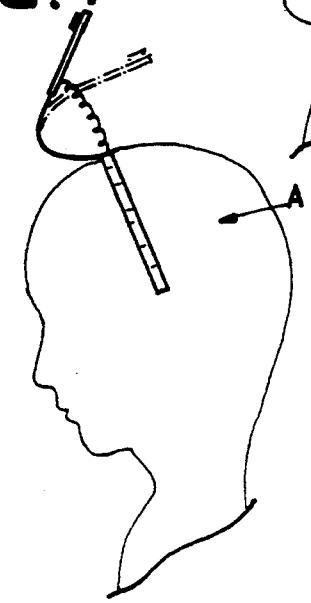
FIG. 4 shows the same as FIG. 2, but with the head bent to show the indicative deflection of the apparatus.

The apparatus comprises a balance member 1 which is shown in FIG. 1 as an elongate plate member connected for springing movement with and unstably supported by a base section 2 attached to a hair band 3 that may be placed on a person's head, as is shown in FIGS. 2 and 4. The balance member 1 is, as shown in FIG. 1, connected with the base section 2 by means of a U-shaped flexible, springy band 4. This U-shaped band 4 may either be an integral part of the balance member 1, or may be attached thereto by one leg **4*b* thereof with the aid of screws, pins or glue, and may with its other leg 4*c* constitute base section 2 or be attached to a base section 2 in the same manner, which in turn is attached to the hair band 3 in an expedient way. When the apparatus is in position for use upon a head, the U-shaped band 4 with its midsection 4*a* faces forward in the direction of the head, i.e., the legs 4*b*, 4*c* of the U-shape face backward. On balance member 1, which is constructed of a material as lightweight as possible, there are placed weights 6, namely a weight at each end of the balance member and near the longitudinal edge thereof opposite band 4. This is intended to afford the greatest possible spring effect or movability in the U-shaped band. An important purpose of band 4 in addition to a slight spring action is to guide the direction of movement of balance member 1 relative to base section 2, viz. such that balance member 1 primarily swings about an axis running transversly to band 4 in the proximity of its midsection 4*a*. Thus, by making band 4 relatively wide, said swinging movement is permitted, while tilting movements of balance member 1** crosswise to the band are substantially reduced.

To achieve maximal movability about said rotational axis, band 4 may be constructed with a very slight spring force which would not, for example, be sufficient to hold balance member 1 and its weights 6 at a desired distance from base section 2. In order to attain the desired distance between said sections 1 and 2, a helical compression spring 5 may be positioned between base section 2 and balance member 1, which to some degree equalizes or counteracts the weight of balance member 1 and the weights 6. Thus will enable balance member 1 to be moved very easily and to tip forward when the apparatus is positioned on a person's head, as shown in FIG. 2, and the head is bent forward as shown in FIG. 4. Hence, balance member 1 will tip forward and will indicate that the user has assumed an incorrect back posture with the head in this position. This tipping of balance member 1 due to the mentioned position of the head is registered by the user's nerves, which are capable of sensing that the center of gravity of the apparatus has been displaced. When the head is raised up and, accordingly, the back posture is also straightened, balance member 1 will swing back to its starting point, which is also registered by the user.

The weight elements 6 may be detachable, and may thus be replaced by different weights, or said weight elements may be augmented with partial weights.

Figure 3:
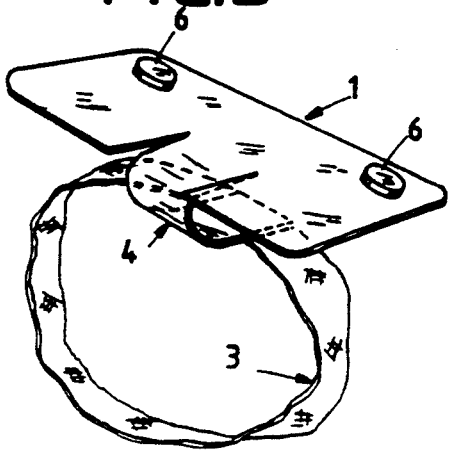
FIG. 3 shows an alternative embodiment of the apparatus placed on an elastic forehead band.

In an embodiment form as shown in FIG. 3, balance member 1 with band 4 and optionally base section 2 may be constructed as a unit from a sufficiently rigid and resilient material, which may, for example, form a flat blank that is stamped out of a sheet material and then bent into the correct shape.

I claim:

1. An apparatus to be attached to a head of a person to indicate correct or faulty back posture during execution of various activities in an upright or sitting position, comprising:

attachment means for attaching said apparatus to a top portion of said head;

an elongate balance member;

a base section connected to said attachment means;

a flexible, U-shaped band having a first and a second leg, said first leg being attached to a midsection of said balance member, said second leg being attached to said base section;

said flexible, U-shaped band extending transversely of a longitudinal direction of said balance member, mean center of gravity of said balance member being situated at a distance from a midsection of said flexible, U-shaped band, said legs of said flexible, U-shaped band facing rearward relative to the person's head during use of said apparatus; and whereby, in case of head positions and consequent back positions that deviate from correct back posture, said balance member will tip in a direction of inclination of the head.

2. An apparatus according to claim 1, further comprising spring means being positioned between said base section and said midsection of said balance member.

3. An apparatus according to claim 2, wherein said balance member is provided with weight means located transversely of said flexible, U-shaped band.

4. An apparatus according to claim 1, further comprising spring means being positioned between extreme ends of said legs of said flexible, U-shaped band.

5. An apparatus according to claim 4, wherein said balance member is provided with weight means located transversely of said flexible, U-shaped band.

6. An apparatus according to claim 1, wherein said balance member and said flexible, U-shaped band are made as an integral unit.

7. An apparatus according to claim 6, wherein said unit is stamped out of a resilient sheet material and bent into said U-shape.

* * * * *